US005802198A

United States Patent [19]

Beavers et al.

[11] Patent Number: 5,802,198

[45] Date of Patent: Sep. 1, 1998

[54] HERMETICALLY SEALED CONDENSER MICROPHONE

[75] Inventors: Bob Ray Beavers, Vista; Michael DeAngelo, Anaheim, both of Calif.

[73] Assignee: Northrop Grumman Corporation, Los Angeles, Calif.

[21] Appl. No.: 805,962

[22] Filed: Feb. 25, 1997

[51] Int. Cl.[6] ..... H04R 25/00

[52] U.S. Cl. ..... 381/344; 381/355; 381/360

[58] Field of Search ..... 381/168, 169, 381/157, 183, 187, 174, 191, 113, 344, 355, 360, 375, 376; 379/175, 430; 128/201.19, 205.25; 367/132

[56] References Cited

U.S. PATENT DOCUMENTS

| | | | |
|---|---|---|---|
| 825,635 | 7/1906 | Brewer . | |
| 1,026,057 | 5/1912 | Shreeve . | |
| 1,541,450 | 6/1925 | Walker . | |
| 2,552,800 | 5/1951 | Lybarger . | |
| 2,937,244 | 5/1960 | Weinger | 381/187 |
| 3,633,705 | 1/1972 | Teder . | |
| 3,789,166 | 1/1974 | Sebesta . | |
| 4,542,264 | 9/1985 | Schmidt et al. | 381/191 |
| 4,926,398 | 5/1990 | Fincher | 381/169 |
| 5,548,658 | 8/1996 | Ring et al. | 381/191 |
| 5,570,428 | 10/1996 | Madaffari et al. | 381/191 |
| 5,574,794 | 11/1996 | Valley | 381/168 |

FOREIGN PATENT DOCUMENTS

| | | | |
|---|---|---|---|
| 2064263 | 6/1981 | United Kingdom | 381/168 |

*Primary Examiner*—Huyen Le

*Attorney, Agent, or Firm*—Terry J. Anderson; Karl J. Hoch, Jr.

[57] ABSTRACT

A hermetically sealed condenser microphone including an outer sealing diaphragm hermetically sealing an electroacoustic transducer within a case from the outside environment. The sealing diaphragm passes sound undiminished through an underlying intervening air space to a second active diaphragm of the electroacoustic transducer. Specifically, the case has a hollow interior, a sealed end and an open end. The electroacoustic transducer is disposed within the hollow interior of the case, and the sealing diaphragm disposed over the top of the open end of the case such that the hollow interior of the case is completely sealed. An acoustic signal first impinges upon the sealing diaphragm causing deflections therein which in turn recreate the acoustic signal undiminished in the air space within the case between the sealing diaphragm and the active diaphragm. The recreated acoustic signal then impinges on the active diaphragm of the electroacoustic transducer causing deflections therein that are converted to an electrical signal outputable from the microphone. Thus, the sealing diaphragm prevents water vapor and other contaminants from coming into contact with the internal components of the microphone, while still allowing the acoustic signal to reach the active diaphragm.

20 Claims, 1 Drawing Sheet

HERMETICALLY SEALED CONDENSER MICROPHONE

BACKGROUND OF THE INVENTION

1. Technical Field

This invention relates to a condenser microphone, and particularly to a condenser microphone which is hermetically sealed from the outside environment.

2. Background Art

Condenser microphones are widely used to convert acoustic signals to proportionate electrical signals, such as is necessary in electronic voice communication applications. These conventional microphones typically include a capacitive transducer made in such a manner that one electrode of a capacitor structure is formed by an electrically conductive diaphragm. This diaphragm is disposed adjacent to, but insulated from, a stationary electrode forming the second electrode of the capacitor structure. The two electrodes are spaced apart with an air gap in-between. A relatively high DC bias voltage is applied between the electrodes. Variations in the electrode spacing caused by deflections of the diaphragm in response to the force of acoustic wave energy incident on the diaphragm, produce a change in capacitance. A detection network is connected to the capacitive transducer such that the change in capacitance is detected and transformed into an electrical signal proportional to the force of the acoustic wave energy applied to the diaphragm.

Conventional condenser microphones have not been completely sealed from the atmosphere in the past because they would become inoperative in the face of variations in barometric pressure or altitude. For instance, an increase in the atmospheric pressure outside the diaphragm would tend to deflect it towards the stationary planar electrode of the transducer, thus introducing an error in the electrical signal output from the device and reducing the device's sensitivity to actual acoustic inputs. To alleviate this problem, traditional condenser microphones included a vent or pressure relief hole in the diaphragm, which allowed air to flow between the region outside and inside of the diaphragm to equalize the pressure and prevent the aforementioned unwanted deflection.

Although the diaphragm vent hole prevented changes in external pressure from affecting the performance of the microphone, it also introduced some undesirable side effects. For instance, water vapor can be introduced into the air space between the diaphragm and the stationary electrode when air having a high relative humidity is drawn onto this space to equalize an increase in the external air pressure. This water vapor can have deteriorative effects on the transducer components. Similarly, if the microphone was submersed in water, the vent hole would allow water into the space inside the diaphragm, thereby damaging or making the transducer inoperative. In addition, the vent hole allows contaminants, such as dust, to enter the space under the diaphragm. This could cause electrical noise if the contaminants come into contact with the sensitive stationary electrode of the transducer, or possibly with the electronics of the detector circuit. The contaminants might also clog the vent hole and cause the same problems described previously in connection with the need for a equalization port in the diaphragm.

The only heretofore known microphone that has been sealed from its outside environment are those employing a diaphragm with a high mechanical impedance. A hydrophone is an example of this type of microphone. These microphones have a bladder connected to the space behind the diaphragm which expands and contracts to equalize the aforementioned internal/external pressure difference. However, a condenser microphone requires a diaphragm having a much lower mechanical impedance. A bladder consistent with the size of a condenser microphone would not be able to absorb all the air displacement necessary to equalize the inside pressure to that of the ambient environment.

Therefore, what is needed is a condenser-type microphone which is completely sealed from the environment external to the diaphragm of the transducer, and still capable of operating efficiently in the face of changing ambient pressures.

SUMMARY

Wherefore, it is an object of the present invention to provide a condenser microphone which is hermetically sealed from the outside environment such that water vapor and other contaminants are prevented from coming into contact with the internal components of the microphone.

Wherefore, it is another object of the present invention to provide a hermetically sealed condenser microphone which can continue to operate efficiently even when subjected to large changes in ambient pressure.

The foregoing objects have been attained by a condenser microphone incorporating elements of the present invention which makes use of the unique concept of splitting the function of the diaphragm. A outer sealing diaphragm hermetically seals the unit from the outside environment, but passes sound undiminished through an underlying intervening air space to a second active diaphragm which is part of an electroacoustic transducer. The second diaphragm includes a vent hole to equalize any pressure differences between the air space formed between the two diaphragms, and the air space behind the active diaphragm of the transducer.

Specifically, a hermetically sealed condenser microphone according the to the present invention includes a case having a hollow interior, a sealed end and an open end; an electroacoustic transducer disposed within the hollow interior of the case and having an active diaphragm; and a sealing diaphragm disposed over the top of the open end of the case, such that the hollow interior of the case is completely sealed from the outside environment. An acoustic signal first impinges upon the sealing diaphragm causing deflections therein which in turn recreate the acoustic signal undiminished in an air space within the case between the sealing diaphragm and the active diaphragm. The recreated acoustic signal then impinges on the active diaphragm of the electroacoustic transducer causing deflections therein that are converted to an electrical signal outputable from the microphone. Thus, the sealing diaphragm prevents water vapor and other contaminants from coming into contact with the internal components of the microphone, while still allowing the acoustic signal to reach the active diaphragm.

Preferably, the impedance of the sealing diaphragm is made small enough in comparison to the impedance of the active diaphragm so as to ensure the sensitivity of the microphone is not significantly degraded In addition, it is preferred that the air space between the sealing diaphragm and the active diaphragm is made small enough so as to substantially maximize acoustic coupling between the two diaphragms. This can be accomplished by making the aforementioned hollow interior of the case a central cavity. The top surface of the open end of the case formed by sidewalls surrounding the central cavity are sloped downward from a peripheral edge of the open end to a upper end of the central cavity, and the electroacoustic transducer is disposed within the central cavity such that a top end thereof including the active diaphragm is substantially flush with the upper end of the central cavity. A peripheral edge of the sealing diaphragm is also attached to the peripheral edge of the open end of the case. The aforementioned top surface of the case is sloped an amount sufficient to allow room for the sealing diaphragm to undergo a maximum inward deflection without contacting the top surface, while still minimizing the air space between the sealing diaphragm and the active diaphragm. Thus this preferred structure ensures a close coupling between the diaphragms.

In addition, it is preferred that the sealing diaphragm has a maximum displacement substantially corresponding to the total volume of air contained within the case. This allows the microphone to operate efficiently, even when subjected to large changes in ambient pressure.

Further, the sealing diaphragm and the active diaphragm are preferably made of the same material. This increases the sensitivity of the microphone. Specifically, it is preferred that the sealing diaphragm and the active diaphragm be made of titanium foil. It is also preferred that the case and the sealing diaphragm be made of materials having closely matched rates of thermal expansion. This maintains a desired tension on the sealing diaphragm, even though the microphone is subjected to varying temperatures. Similarly, the active diaphragm and a retaining structure thereof are also preferably made of materials having closely matched rates of thermal expansion to maintain a desired tension on the active diaphragm in the face of varying temperatures. By maintaining the desired tension on both diaphragms, their aforementioned preferred impedance ratio is also maintained. The case and sealing diaphragm are also ideally made from corrosion resistant materials to withstand wet environments without degrading. Both the matching of expansion rates and corrosion resistance can be obtained by making the sealing diaphragm from titanium foil, and the case from titanium metal.

The peripheral edge of the sealing diaphragm is bonded to a peripheral edge of the open end of the case. Although this can be done via conventional adhesives, it is preferred that the diaphragm be bonded to the case using a thermal diffusion bond. Also, it is preferred that the active diaphragm include a vent hole for equalizing relative pressure between air contained with the airspace between the sealing diaphragm and the active diaphragm, and air contained within the electroacoustic transducer, interior of the active diaphragm.

It can be seen that all the stated objectives of the invention have been accomplished by the above-described embodiments of the present invention. In addition, other objectives, advantages and benefits of the present invention will become apparent from the detailed description which follows hereinafter when taken in conjunction with the drawing figures which accompany it.

DESCRIPTION OF THE DRAWINGS

These and other features, aspects, and advantages of the present invention will become better understood with regard to the following description, appended claims, and accompanying drawings where:

DETAILED DESCRIPTION OF THE PREFERRED EMBODIMENTS

Figure 1:
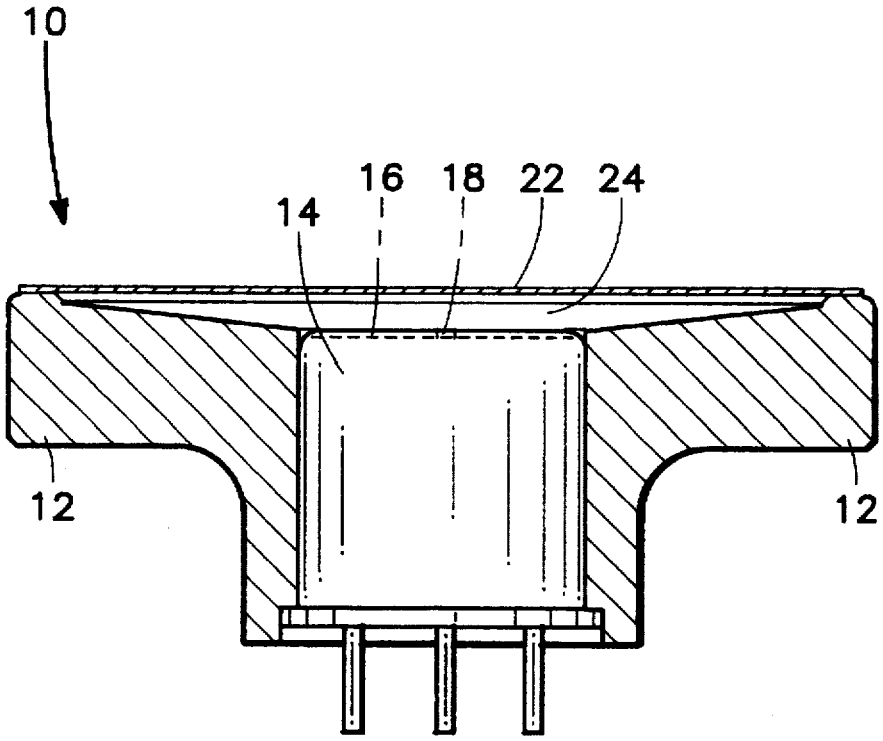
FIG. 1 is a cross-sectional view of a hermetically sealed condenser microphone incorporating features of the present invention.

FIG. 1 shows a hermetically sealed condenser microphone 10 in accordance with a preferred embodiment of the present invention. The microphone 10 has a case 12 having a central cavity and a top surface which slopes down from its peripheral edge toward the central cavity. An electroacoustic transducer 14 is disposed in the central cavity of the case 12, such that the top surface of the electroacoustic transducer 14 is flush with the top rim of the case's central cavity. The electroacoustic transducer 14 has an active diaphragm 16 which includes a vent hole or aperture 18. Preferably, the electroacoustic transducer 14 fits snugly in the central cavity of the case 12. Even so, to prevent intrusion of the outside environment into the interior of the hermetically sealed condenser microphone 10, the bottom end of the electroacoustic transducer 14 is sealed to the case 12. Preferably, this is accomplished with a solder seal which also serves the purpose of anchoring the electroacoustic transducer 14 in the central cavity of the case 12.

A sealing diaphragm 22 stretches over the top of the case 12 above the electroacoustic transducer 14. This creates a intervening air space 24 between the active diaphragm 16 of the electroacoustic transducer 14 and the sealing diaphragm 22. The sealing diaphragm 22 is attached to the periphery of the case 12, thus completely sealing the inside of the case 12 from the outside environment. Preferably, the sealing diaphragm 22 is attached to the case 12 by thermal diffusion. This can be accomplished using any appropriate conventional thermal diffusion technique. Although the thermal diffusion method is preferred, if desired, the sealing diaphragm 22 could be bonded to the case 12 with the use of conventional adhesives.

In operation, the just-described embodiment hermetically seals the internal components of the condenser microphone 10 from external contaminants, such as water vapor and dust. The sealing diaphragm 22 seals the microphone 10, but allows acoustic signals to pass practically undiminished through to the airspace 24 beyond, and eventually to the active diaphragm 16 of the electroacoustic transducer 14, where the actual transduction takes place.

It is preferred that the impedance of the sealing diaphragm 22 be made small with respect to the active diaphragm 16 in order to avoid a loss of sensitivity of the microphone 10. This can be accomplished by making the sealing diaphragm 22 loosely tensioned in comparison to the active diaphragm 16. In the preferred embodiment of the present invention, the sealing diaphragm 22 has a tension of less than about 0.1 N/m, and the active diaphragm 16 has a tension of about 12.0 to 27.8 N/m. This produced an acceptable sensitivity.

Second, the volume of the air space 24 between the two diaphragms 16, 22 should be made as small as practical in order to maximize the acoustic coupling between the diaphragms. In the tested embodiment, the case 12 is cylindrical in shape with a diameter of approximately 1.0 inches. The central cavity of the case 12 is also cylindrical and has a diameter of 0.30 inches (with the active diaphragm 16 of the electroacoustic transducer 14 having a diameter of 0.28 inches). As discussed above, the upper region of the case 12 is sloped to reduce the size of the air space 24 between the two diaphragms 16, 22. In the tested embodiment, the above dimensions and the sloped upper region resulted in the volume of the air space 24 between the sealing diaphragm 22 and the active diaphragm 16 being approximately 0.16 cubic inches. This produces an acceptable acoustic coupling between the active and sealing diaphragms 16, 22.

The total internal air volume of the microphone 10 will determine the volume of displacement required of the sealing diaphragm 22 in order to compensate for any changes in the ambient pressure. The total internal air volume will equal the volume of the air space 24 between then the two diaphragms 16, 22, plus the volume of air inside the electroacoustic transducer 14 itself. In the tested embodiment this amounts to about 0.30 cubic inches, i.e. the approximately 0.14 cubic inches in the air space 24 between the diaphragms 16, 22, plus approximately 0.14 cubic inches of air inside the particular electroacoustic transducer 14 employed. The circular sealing diaphragm having a diameter of approximately 1.0 inch used in the tested embodiment was capable of displacements sufficient to handle any practical changes in ambient pressure. If a microphone in accordance with the present invention having larger internal volumes is employed, the size of the sealing diaphragm can be increased to accommodate the increased volume.

Finally, the vibration sensitivity of the microphone 10 will be doubled if material having the same surface density is used for both diaphragms 16, 22. In the tested embodiment, the sealing diaphragm 22 and active diaphragm are made of 0.0001 inch thick titanium foil. In addition, it is preferred that the case 12 be made of titanium metal. The purpose of the use of titanium is two-fold. First, titanium resists corrosion. The microphone 10 of the present invention is envisioned to be used in wet environments, and may even be submerged in water. Thus, corrosion resistance of titanium has distinct advantages. In addition, making the sealing diaphragm 22 and the case 12 out of the same material means that their rates of thermal expansion will be the same. This will ensure that the desired tension on the sealing diaphragm 22 remains the same even in the face of changing ambient temperatures. It is important to maintain a constant tension on the sealing diaphragm 22 because the impedance of the sealing diaphragm 22 must be made small with respect to the active diaphragm 16 in order to avoid loss of sensitivity. If the tension in the sealing diaphragm 22 where to change enough to upset this impedance ratio, the sensitivity of the microphone 10 could be adversely affected. It should also be noted that it is desirable for the electroacoustic transducer 14 employed in the present invention to exhibit a substantially constant active diaphragm 16 tension in the face of changing ambient temperatures, as well. Such a feature would ensure that the tension of the active diaphragm 16 does not change in relationship to the sealing diaphragm 22 enough to effect the aforementioned impedance ratio, and so degrade the microphone's sensitivity characteristics. Such an electroacoustic transducer is disclosed in a co-pending patent application by the inventor herein entitled WAFER FABRICATED ELECTROACOUSTIC TRANSDUCER, Ser. No. 08/711,444, filed Sept. 6, 1996.

Additionally, it is preferred that the active diaphragm 16 of the electroacoustic transducer 14 have a vent hole 18 which is approximately 0.001 inches in diameter. This size vent hole 18 will release the static pressure on the active diaphragm 16, as previously discussed.

While the invention has been described in detail by reference to the preferred embodiment described above, it is understood that variations and modifications thereof may be made without departing from the true spirit and scope of the invention.

Wherefore, what is claimed is:

1. A hermetically sealed condenser microphone, comprising:

(a) a case comprising a hollow interior, a sealed end and an open end;

(b) an electroacoustic transducer disposed within the hollow interior of the case and having an active diagram; and (c) a sealing diaphragm, comprised of the same materials as the active diagram so as to increase the sensitivity of the microphone, disposed over the top of the open end of the case such that the hollow interior of the case is completely sealed from the outside environment, and wherein, (d) an acoustic signal first impinges upon the sealing diaphragm causing deflections therein which in turn recreate the acoustic signal undiminished in an air space within the case between the sealing diaphragm and the active diaphragm; and, (e) the recreated acoustic signal impinges on the active diaphragm of the electroacoustic transducer causing deflections therein that are converted to an electrical signal outputable from the microphone.

2. The microphone of claim 1, wherein:

impedance of the sealing diaphragm is made small enough in comparison to the impedance of the active diaphragm so as to ensure the sensitivity of the microphone is not significantly degraded.

3. The microphone of claim 1, wherein:

the air space between the sealing diaphragm and the active diaphragm is made small enough so as to substantially maximize acoustic coupling between the two diaphragms.

4. The microphone of claim 3, wherein:

(a) the hollow interior of the case comprises a central cavity within the case;

(b) a top surface of the open end of the case formed by sidewalls surrounding the central cavity are sloped downward from a peripheral edge of the open end to a upper end of the central cavity;

(c) the electroacoustic transducer is disposed within the central cavity such that a top end thereof comprising the active diaphragm is substantially flush with the upper end of the central cavity; and, (d) a peripheral edge of the sealing diaphragm is attached to the peripheral edge of the open end of the case; and wherein, (e) the top surface of the case is sloped an amount sufficient to allow room for the sealing diaphragm to undergo a maximum inward deflection without contacting the top surface, while still minimizing the air space between the sealing diaphragm and the active diaphragm.

5. The microphone of claim 1, wherein:

the sealing diaphragm has a maximum displacement substantially corresponding to a total volume of air contained within the case.

6. The microphone of claim 1, wherein:

(a) the case and the sealing diaphragm comprise materials having closely matched rates of thermal expansion, thereby maintaining a desired tension on the sealing diaphragm whenever the microphone is subjected to varying temperatures; and, (b) the active diaphragm and a retaining structure thereof comprise materials having closely matched rates of thermal expansion, thereby maintaining a desired tension on the active diaphragm whenever the microphone is subjected to varying temperatures.

7. The microphone of claim 6, wherein:

the case and sealing diaphragm comprise corrosion resistant materials.

8. The microphone of claim 1, wherein:

a peripheral edge of the sealing diaphragm is bonded to a peripheral edge of the open end of the case by a thermal diffusion bond.

9. The microphone of claim 1, wherein:

the active diaphragm further comprises a vent hole for equalizing relative pressure between air contained with the airspace between the sealing diaphragm and the active diaphragm, and air contained within the electroacoustic transducer interior of the active diaphragm.

10. A hermetically sealed condenser microphone, comprising:

(a) a case comprising a hollow interior, a sealed end and an open end;

(b) an electroacoustic transducer disposed within the hollow interior of the case and having an active diaphragm; and (c) a sealing diaphragm, comprised of the same materials as the active diaphragm so as to increase the sensitivity of the microphone, disposed over the top of the open end of the case such that the hollow interior of the case is completely sealed from the outside environment, and wherein, (d) an acoustic signal first impinges upon the sealing diaphragm causing deflections therein which in turn recreate the acoustic signal undiminished in an air space within the case between the sealing diaphragm and the active diaphragm;

(e) the recreated acoustic signal impinges on the active diaphragm of the electroacoustic transducer causing deflections therein that are converted to an electrical signal outputable from the microphone;

(f) impedance of the sealing diaphragm is made small enough in comparison to the impedance of the active diaphragm so as to ensure the sensitivity of the microphone is not significantly degraded; and (g) the air space between the sealing diaphragm and the active diaphragm is made small enough so as to substantially maximize acoustic coupling between the two diaphragms.

11. The microphone of claim 10, wherein:

the sealing diaphragm has a maximum displacement substantially corresponding to a total volume of air contained within the case.

12. The microphone of claim 10, wherein:

(a) the case and the sealing diaphragm comprise materials having closely matched rates of thermal expansion, thereby maintaining a desired tension on the sealing diaphragm whenever the microphone is subjected to varying temperatures; and, (b) the active diaphragm and a retaining structure thereof comprise materials having closely matched rates of thermal expansion, thereby maintaining a desired tension on the active diaphragm whenever the microphone is subjected to varying temperatures.

13. The microphone of claim 12, wherein:

the case and sealing diaphragm comprise corrosion resistant materials.

14. A hermetically sealed condenser microphone, comprising:

(a) a case comprising a hollow interior, a sealed end and an open end;

(b) an electroacoustic transducer disposed within the hollow interior of the case and having an active diagram;

(c) a sealing diaphragm, comprised of the same materials as the active diagram so as to increase the sensitivity of the microphone, disposed over the top of the open end of the case such that the hollow interior of the case is completely sealed from the outside environment;

(d) wherein an acoustic signal first impinges upon the sealing diaphragm causing deflections therein which in turn recreate the acoustic signal undiminished in an air space within the case between the sealing diaphragm and the active diaphragm;

(e) wherein the recreated acoustic signal impinges on the active diaphragm of the electroacoustic transducer causing deflections therein that are converted to an electrical signal outputable from the microphone; and (f) the sealing diaphragm and the active diaphragm comprising titanium foil.

15. A hermetically sealed condenser microphone, comprising:

(a) a case comprising a hollow interior, a sealed end and an open end;

(b) an electroacoustic transducer disposed within the hollow interior of the case and having an active diagram;

(c) a sealing diaphragm, comprised of the same materials as the active diagram so as to increase the sensitivity of the microphone, disposed over the top of the open end of the case such that the hollow interior of the case is completely sealed from the outside environment;

(d) wherein an acoustic signal first impinges upon the sealing diaphragm causing deflections therein which in turn recreate the acoustic signal undiminished in an air space within the case between the sealing diaphragm and the active diaphragm;

(e) wherein the recreated acoustic signal impinges on the active diaphragm of the electroacoustic transducer causing deflections therein that are converted to an electrical signal outputable from the microphone;

(f) the case and the sealing diaphragm comprising materials having closely matched rates of thermal expansion, thereby maintaining a desired tension on the sealing diaphragm whenever the microphone is subjected to varying temperatures;

(g) the active diaphragm and a retaining structure thereof comprising materials having closely matched rates of thermal expansion, thereby maintaining a desired tension on the active diaphragm whenever the microphone is subjected to varying temperatures;

(h) the case and sealing diaphragm comprising corrosion resistant materials;

(i) the sealing diaphragm comprising titanium foil; and (j) the case comprising titanium metal.

16. A microphone comprising:

a) a case comprising a hollow interior, a sealed end, and an open end;

b) a sealing diaphragm disposed over the open end of the case;

c) the sealing diaphragm sealing the hollow interior such that it forms a hermetically sealed chamber;

d) a transducer disposed within the hermetically sealed chamber, the transducer comprising an active diaphragm;

e) the sealing diaphragm and the active diaphragm form a first space therebetween;

f) the transducer comprises a second space within the transducer adjacent the active diaphragm;

g) an aperture in the active diaphragm; and h) the aperture being sized so as to allow for the equalization of pressure between the first space and the second space but does not inhibit the desired frequency response of the microphone.

17. The microphone of claim 16 wherein the sealing diaphragm and the active diaphragm are sized, disposed, and tensioned such that the transducer is capable of reproducing an acoustic signal impinging the sealing diaphragm when the pressure in the first space is not equal to the ambient pressure against the sealing diaphragm.

18. A microphone comprising:

a) a case comprising a hollow interior, a sealed end, and an open end;

b) a sealing diaphragm disposed over the open end of the case;

c) the sealing diaphragm sealing the hollow interior such that it forms a hermetically sealed chamber;

d) a transducer disposed within the hermetically sealed chamber, the transducer comprising an active diaphragm;

e) the sealing diaphragm and the active diaphragm forming a first space therebetween;

f) the transducer comprising a second space within the transducer adjacent the active diaphragm;

g) an aperture in the transducer; and h) the aperture being such that it allows for the equalization of pressure between the first space and the second space but does not inhibit the desired frequency response of the microphone.

19. The microphone of claim 18 wherein the sealing diaphragm and the active diaphragm are sized, disposed, and tensioned such that the transducer is capable of reproducing an acoustic signal impinging the sealing diaphragm when the pressure in the first space is not equal to the ambient pressure against the sealing diaphragm.

20. A hermetically sealed condenser microphone, comprising:

(a) a case comprising a hollow interior, a sealed end and an open end;

(b) an electroacoustic transducer disposed within the hollow interior of the case and having an active diagram; and (c) a sealing diaphragm, consisting of the same materials as the active diagram so as to increase the sensitivity of the microphone, disposed over the top of the open end of the case such that the hollow interior of the case is completely sealed from the outside environment, and wherein, (d) an acoustic signal first impinges upon the sealing diaphragm causing deflections therein which in turn recreate the acoustic signal undiminished in an air space within the case between the sealing diaphragm and the active diaphragm; and, (e) the recreated acoustic signal impinges on the active diaphragm of the electroacoustic transducer causing deflections therein that are converted to an electrical signal outputable from the microphone.

* * * * *